United States Patent [19]

Slone

[11] 4,280,703

[45] Jul. 28, 1981

[54] THREE DIMENSIONAL GAME WITH POLITICAL THEME

[76] Inventor: Keith W. Slone, 13168 Plum, Southgate, Mich. 48195

[21] Appl. No.: 79,379

[22] Filed: Sep. 27, 1979

[51] Int. Cl.[3] ..... A63F 3/00

[52] U.S. Cl. ..... 273/241; 273/260; 273/257

[58] Field of Search ..... 273/260, 261, 257, 241

[56] References Cited

U.S. PATENT DOCUMENTS

| | | | |
|---|---|---|---|
| D. 221,390 | 8/1971 | Skillman | 273/241 |
| 499,041 | 2/1893 | Robbins | 273/261 |
| 817,233 | 4/1906 | Emmerling | 273/260 |
| 1,016,187 | 1/1912 | Vacek | 273/260 |
| 1,102,594 | 7/1914 | Kiefer | 273/260 |
| 1,160,024 | 11/1915 | Wiggins | 273/260 |
| 1,714,546 | 5/1929 | Caldon | 273/257 |
| 1,877,154 | 9/1932 | Weaver | 273/241 |
| 4,147,359 | 4/1979 | King | 273/248 |

FOREIGN PATENT DOCUMENTS

| | | | |
|---|---|---|---|
| 321219 | 11/1929 | United Kingdom | 273/260 |

*Primary Examiner*—Richard C. Pinkham
*Assistant Examiner*—R. Carl Moy
*Attorney, Agent, or Firm*—Norbert M. Lisicki

[57] ABSTRACT

A game for play by two persons which includes a three-colored game board divided into squares wherein three-dimensional play is involved. Combinations of chess and checker moves are employed for the game pieces.

6 Claims, 3 Drawing Figures

R=RED
W=WHITE
B=BLUE

THREE DIMENSIONAL GAME WITH POLITICAL THEME

BACKGROUND OF THE DISCLOSURE

This invention relates to games and, more particularly, to a combination chess and checker game employing game pieces having designated configurations. The conventional chess and checkerboard game employs a board having a total of 64 squares of alternating, contrasting colors and employs 16 playing pieces for each two players. The game of chess requires a high degree of skill in order to fully employ the technical aspects of the game. The game of checkers, on the other hand, is limited to very few moves and requires less skill.

SUMMARY OF THE INVENTION

It is a general object of this invention to provide a game apparatus which combines some of the complexity of the game of chess with the simplicity of the game of checkers. Further, it is the object of this invention to provide a game apparatus which includes playing pieces having a plurality of different capabilities employing three-dimensional moving capability, all of which may be used in the course of playing the game.

BRIEF DESCRIPTION OF THE DRAWINGS

In the drawings, illustrating the embodiments of the invention.

DESCRIPTION OF THE PREFERRED EMBODIMENT

Figure 1:
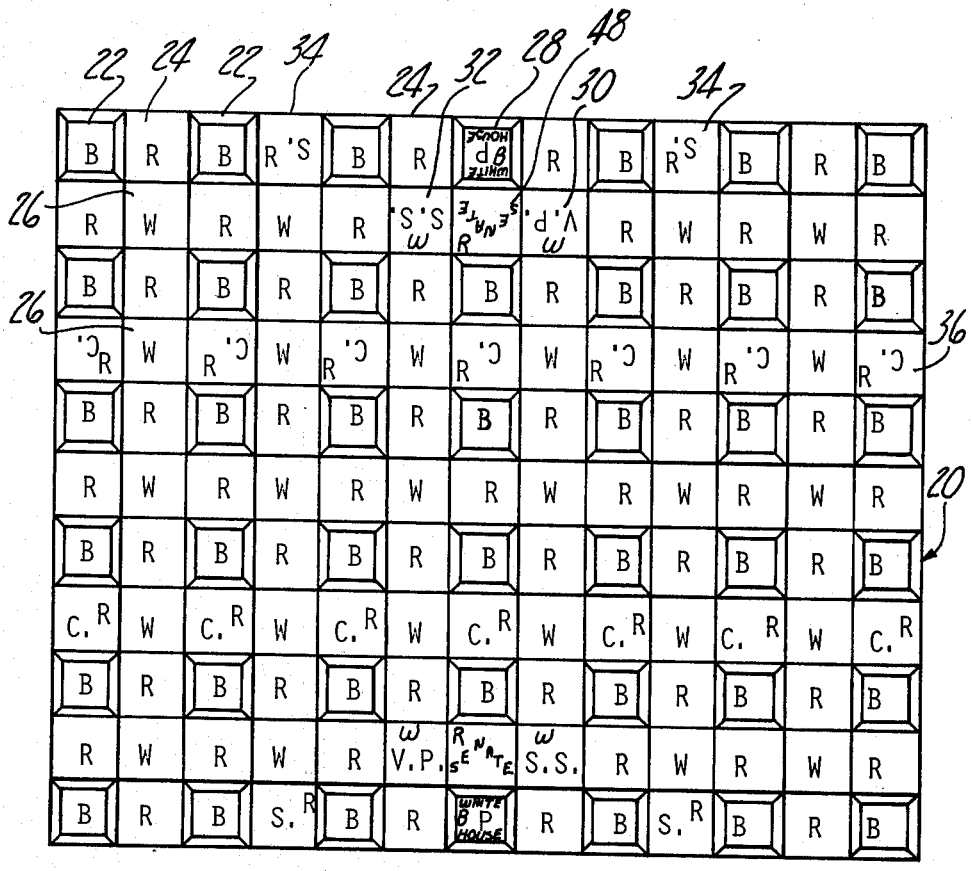
FIG. 1 is a top plan view of the game board indicating the colors of the squares wherein R represents red, W represents white, B represents blue. Furthermore, there can be seen the designations for placement of the various playing pieces upon said board.
Figure 2:
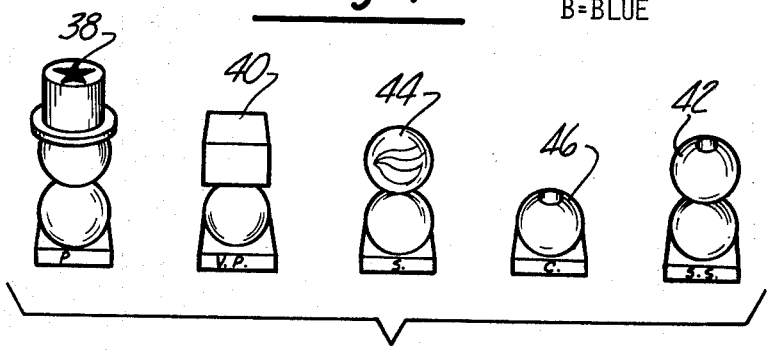
FIG. 2 is a front elevational view of the chess pieces designated P for president, VP for vice-president, S for senator, C for congressman, and SS for secretary of state.

Referring first to FIG. 1 in accordance with the present invention, there is provided a novel checker/chess game comprising a game board 20 consisting of slightly elevated blue squares 22, red squares 24, and white squares 26. The playing pieces are initially distributed as designated below. Blue square 28 designated White House, is occupied by the playing piece, the president 38, designated as P. White square 30 is occupied by the playing piece, the vice-president 40, designated as VP. White square 32 is occupied by the playing piece, the secretary of state 42, designated as SS. Red square 34 are occupied by playing pieces, senators 44, designated as S. Red squares 36 are occupied by playing pieces, congressmen 46, designated as C. The opponent pieces are distributed accordingly.

Figure 3:
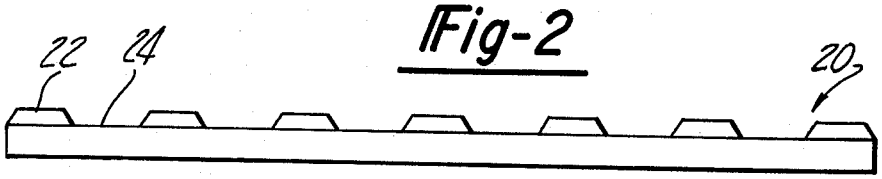
FIG. 3 is a side elevational view of the game board of FIG. 1 indicating the elevations of certain of the board squares which are those designated as B for blue.

In the game of the present invention, a total of 24 pieces is employed. The pieces are divided into two groups of 12 each defining two opposing players. One set of 12 pieces may conveniently be colored red while the other set of 12 pieces may conveniently be colored blue. Each set of pieces contains one president 38, one vice-president 40, one secretary of state 42, two senators 44, and seven congressmen 46. Although the game board may be any size, a convenient size is 26 inches by 22 inches. The game board is then divided into 143, two inch squares. As shown in FIG. 1, there would be 30 white, 71 red, and 42 blue squares. The blue squares are elevated slightly higher than the rest of the game board as shown in FIG. 3. The president 38 sits on the elevated blue blocks 28 and may move in any direction, forward, backward, and diagonally over white blocks to the blue blocks only. The president 38 captures opponent player's pieces by jumping over them but only if the opposing player's pieces are on the white square. The captured pieces are removed from the game board. The president 38 can jump over his own pieces to gain access to a new blue square. Since the president 38 can only capture the pieces on a white square on the lower playing board therefore when the president jumps on an opponent piece on a blue square, he lands on them and removes them. All other pieces which gain access to the blue square, jump identically to the president piece and, at that point, can only jump one square at a time. The president 38 piece can only move from one blue block to another.

The senators 44 move two squares at a time in any direction, forward, backward or diagonally, but must land on a red square. Senators 44, capture the opponent's pieces by landing on them. A player may not cause his senator 44 pieces to jump over his own pieces. He may, however, jump over his opponent's pieces, on white only, if he can capture one or more of his opponents pieces on the red squares. The senator 44 pieces may be used to jump as many times as possible repetitively as long as an opponent's piece is captured each time the senator 44 piece lands on a red square occupied by an opponent's piece.

The congressmen 46 pieces are initially positioned on red squares 36 and are designated as C in the FIG. 1. The congressmen 46 pieces move one square at a time either to a white or red square in any direction except backwards. The congressmen 46 piece captures by landing on the opponent's piece and may jump as many times as possible similar to the senator's capability. The vice-president 40 piece and the secretary of state 42 piece have identical moving capabilities. Both remain on white square, moving two squares in any direction and always landing on the white square. Opponent's pieces are captured by landing on them. Multiple jumps may be made provided that an opponent's piece is captured on each landing. The vice-president 40 piece and the secretary of state 42 piece cannot jump over their own men or over opponent's men.

All board pieces on elevated blue squares capture by landing on the opponent. All board pieces that go to the blue square must continue the game thereafter on the blue squares.

The game is started by one player making a move of one of his pieces. The opponent then moves one of his pieces and the players alternate their moves until one of the president 38 pieces has been captured. The two sets of pieces are conveniently colored red or blue in order to distinguish between them.

In order to win, the player must capture his opponent's president 38 piece. The only playing pieces which are capable of capturing the president 38 piece are the senator 44 pieces and the congressmen 46 pieces. This can be accomplished by moving the senator 44 pieces or the congressmen 46 pieces to the red square designated 48 in FIG. 1. Red square 48 is marked Senate. At this point, the senator 44 piece may move one square to the blue square 28 marked White House and capture the president 38 piece if the president piece is still there. The president piece may move as previously indicated. The congressmen 44 piece may also, at this point, move to the blue square 28 marked White House from red square 48 marked Senate. After either or both congressmen or senator pieces have moved to the blue square, they may only move from blue square to blue square over the white squares identical to the moves possible by the president 38 piece. One president 38 piece may not capture another president 38 piece. In the Drawings, the designations for the various squares and positions are intended to be identical for both sides of the board. Variations and modifications are possible without departing from the spirit of the invention.

The embodiments of the invention in which an exclusive privilege or property are claimed are described as follows:

1. A board game to be played by two persons, said board game comprising:

(a) a board having a single, continuous playing surface thereon, said playing surface having a plurality of squares, said plurality of squares having three different designated colors, one of said three different designated colored plurality of squares further being elevated above the plane of the surface of the second and the third of said three different designated colored plurality of squares, the plane of the surface of the second and the third of said three different designated colored plurality of squares further being on the same plane, such that no part of an elevated square is positioned above another square; and (b) a set of game pieces disposed on said playing surface, each of said set of game pieces having identifying designation thereon and being divided into two equal groups, said identifying designation on each of said set of game pieces further being used to determine the varying capabilities of movement of each of said set of game pieces over said three different designated colored plurality of squares of the game board.

2. The board game of claim 1 wherein said board is divided into 143 squares.

3. The board game of claim 1 wherein the distribution of colored squares is 30 of one color, 71 of another color and 42 of a third color.

4. The board game of claim 1 wherein said one of said three different designated colored plurality of squares is disposed on said playing surface contiguous to at least one of said second and said third of said three different designated colored plurality of squares.

5. The board game of claim 4 wherein said one of said three different designated colored plurality of squares is separated transversely and longitudinally from another of said one of said three different designated colored plurality of squares by one of said second of said three different designated colored plurality of squares.

6. The board game of claim 5 wherein said one of said three different designated colored plurality of squares is separated diagonally from one other of said one of said three different designated by one of said third of said three different designated colored plurality of squares.

* * * * *